US005927531A

United States Patent [19]

Kuzma et al.

[11] Patent Number: 5,927,531

[45] Date of Patent: Jul. 27, 1999

[54] COMBINATION CONTAINER AND CLOSURE WHEREIN SAID CLOSURE IS HELD AGAINST ROTATIONAL AND VERTICAL MOVEMENT ON SAID CONTAINER

[75] Inventors: Gene J. Kuzma; Douglas W. Weaver, both of Columbus, Ohio

[73] Assignee: G K Packaging, Inc., Columbus, Ohio

[21] Appl. No.: 08/965,551

[22] Filed: Nov. 6, 1997

[51] Int. Cl.[6] ..... B65D 41/52

[52] U.S. Cl. ..... 215/321; 215/43; 215/45; 215/320; 215/354; 220/780; 220/296; 220/DIG. 13

[58] Field of Search ..... 215/320, 321, 215/43, 45, 354; 220/293, 296, DIG. 13, 780, 789

[56] References Cited

U.S. PATENT DOCUMENTS

| | | | |
|---|---|---|---|
| 2,718,980 | 9/1955 | Strom | 220/780 |
| 2,778,525 | 1/1957 | Lermer | 220/780 |
| 2,790,576 | 4/1957 | Lawrence | 215/43 X |
| 2,947,432 | 8/1960 | Marcel | 215/321 |
| 3,194,455 | 7/1965 | Castelli . | |
| 3,261,516 | 7/1966 | Allen . | |
| 3,325,066 | 6/1967 | Allen . | |
| 3,342,385 | 9/1967 | Knight . | |
| 3,430,798 | 3/1969 | Goyet et al. | 215/320 X |
| 3,470,930 | 10/1969 | Jurczenia | 220/780 |
| 3,527,372 | 9/1970 | Manning | 220/296 |
| 3,696,957 | 10/1972 | Van Baarn | 215/320 |
| 3,828,962 | 8/1974 | Atkins . | |
| 3,923,184 | 12/1975 | Choksi et al. | 215/45 X |
| 4,076,152 | 2/1978 | Mumford . | |
| 4,230,230 | 10/1980 | Mumford | 215/321 |
| 4,709,825 | 12/1987 | Mumford . | |
| 5,740,932 | 4/1998 | Battegazzore | 215/321 X |

FOREIGN PATENT DOCUMENTS

| | | | |
|---|---|---|---|
| 497328 | 12/1950 | Belgium | 215/320 |
| 1345466 | 10/1963 | France | 215/321 |

*Primary Examiner*—Stephen K. Cronin
*Assistant Examiner*—Robin A Hylton
*Attorney, Agent, or Firm*—John L. Gray; Kegler, Brown, Hill & Ritter

[57] ABSTRACT

A combination container and closure provided with matching, engaging lugs or a ring on said closure and said container and an interior ring on said closure fitting within the opening on said container.

4 Claims, 5 Drawing Sheets

Fig. 3
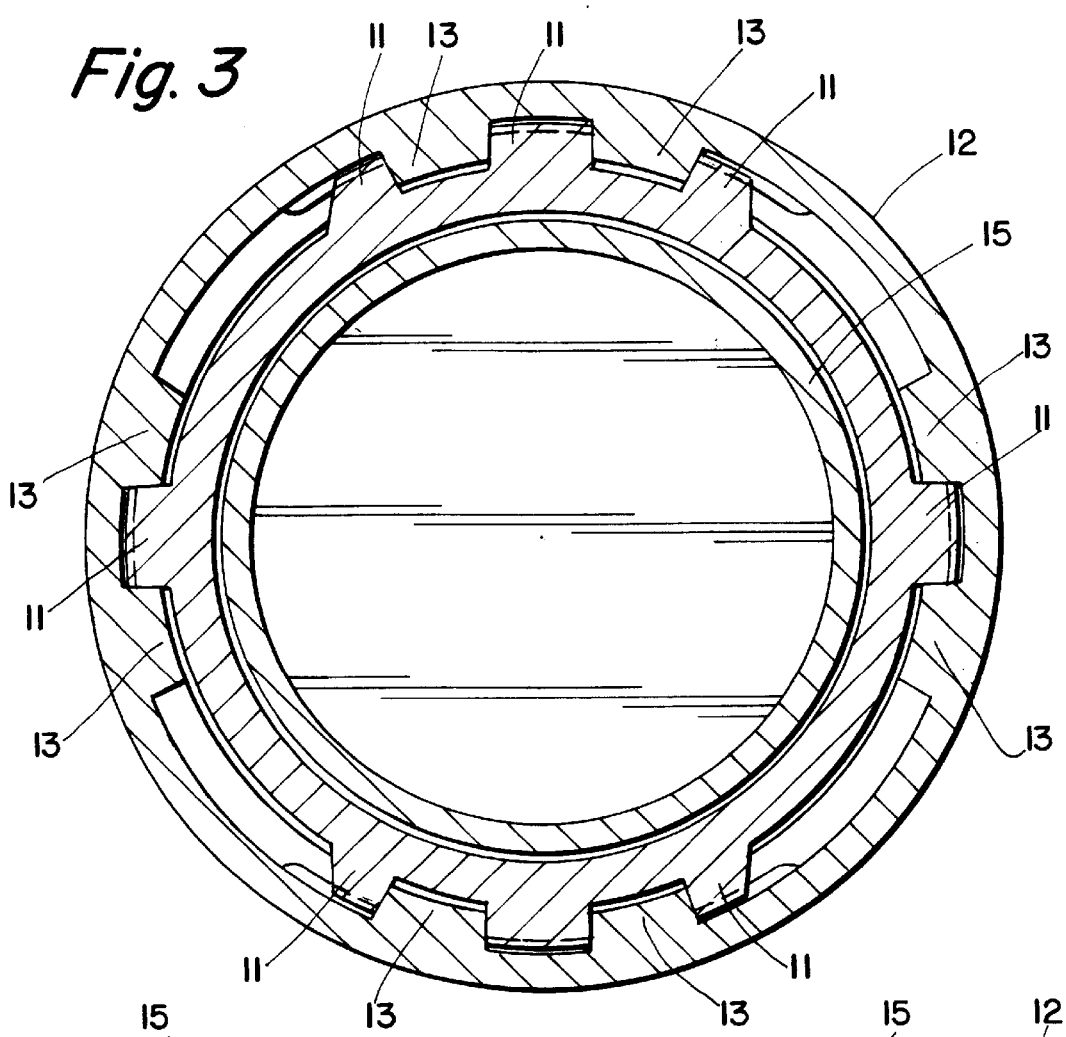
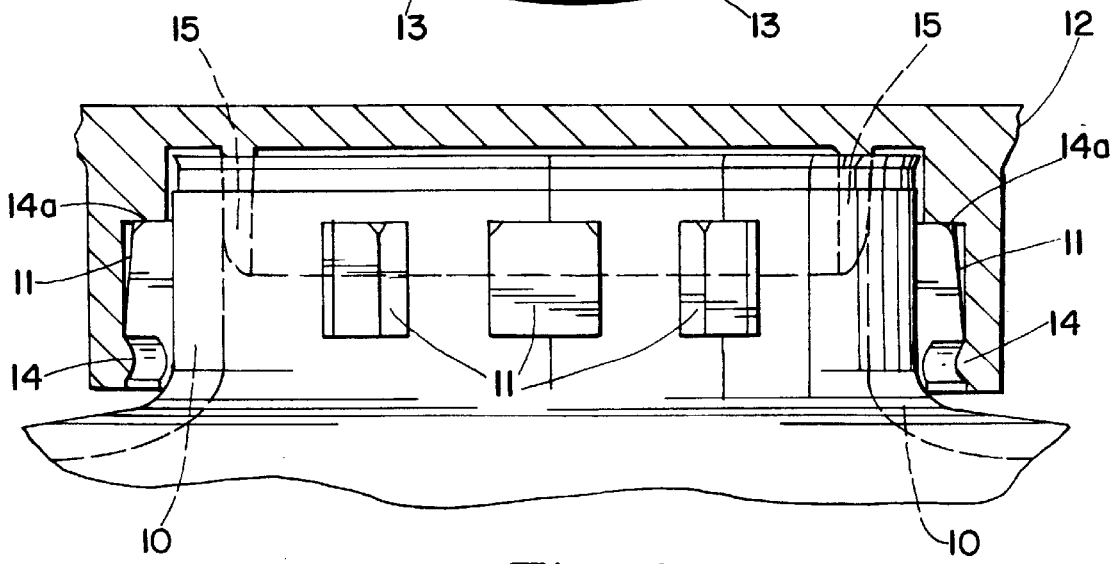
Fig. 4

COMBINATION CONTAINER AND CLOSURE WHEREIN SAID CLOSURE IS HELD AGAINST ROTATIONAL AND VERTICAL MOVEMENT ON SAID CONTAINER

BACKGROUND OF THE INVENTION

The use of matching lugs in connection with seating a container closure on a container has been used in various forms as is shown by U.S. Pat. Nos. 3,194,455, Castelli and 3,325,066, Allen. However, none of the prior art has addressed the problem of variations in the height of the upper lip of the opening of the closure which is known as the land, and which dimension is very difficult to maintain precisely in the molding process.

BRIEF SUMMARY OF THE INVENTION

Applicants' invention provides a combination container and closure whereby the closure fits snugly over the opening of the container by inter-engaging vertically extending lugs spaced on the exterior of the opening of the container and the interior of the corresponding portion of the closure. If prevention of rotational movement of the closure is not essential, a horizontally extending ring may be substituted for the lugs. In addition there is provided an interior ring in the closure which seats on top of the vertical lugs above the land so as to compensate for variations in the height of the land in the molding process and also, rigidly to secure said closure on said container. While the preferred version of this invention contemplates this structure, the invention also contemplates positioning the lugs or horizontally extending ring in the vicinity of the base of the finish of the container.

It is therefore an object of this invention to provide a combination container and a closure which provides for rigid securement of said closure on said container and also compensates for significant variations in the height of the land above the lower edges of the vertically extending lugs on the exterior of the opening or base of the finish of the container.

This, together with other objects of the invention, will become apparent from the following detailed description of the invention and the accompanying drawings.

BRIEF DESCRIPTION OF THE DRAWINGS

FIG. 3 is a section of FIG. 2 on lines 3—3.

FIG. 4 is a section of FIG. 2 on lines 4—4

DETAILED DESCRIPTION OF THE INVENTION

Figure 1:
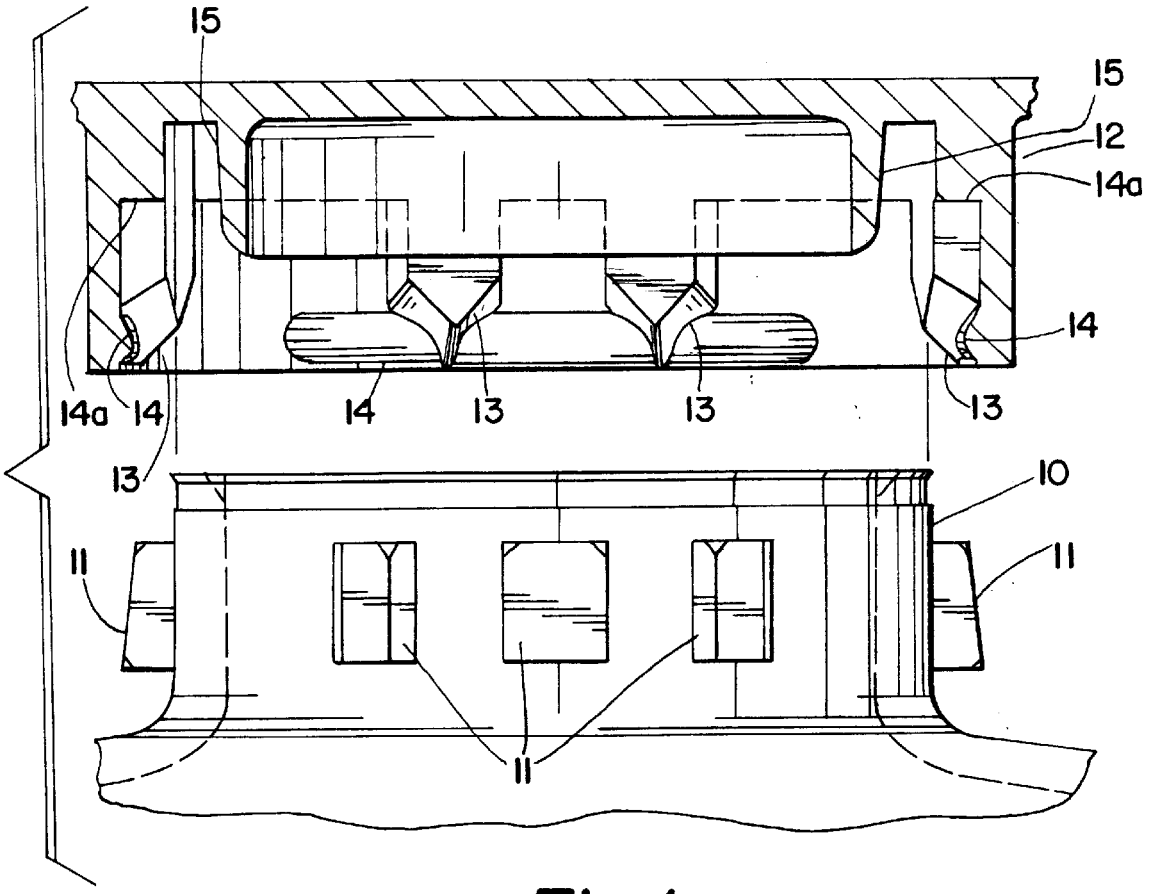
FIG. 1 is a side elevation view showing the opening of the container spaced from the closure which is partially in section.
Figure 11:
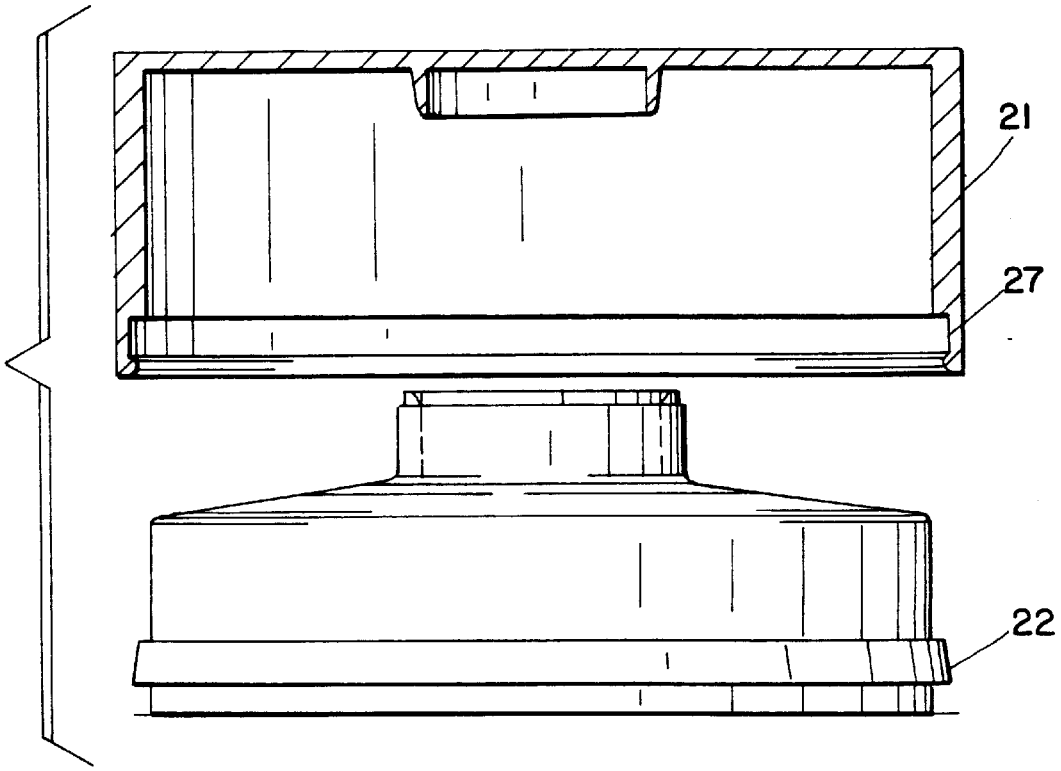
FIG. 11 is a side elevation view showing the container spaced from the closure which is partially in section wherein the ring is located on the base of the finish of the container.

Referring now to the drawings, FIG. 1 shows the upper portion of the container 16 with an opening 10 provided with a plurality of vertically extending lugs 11. It is understood that these lugs or the horizontally extending ring could also be positioned in the vicinity of the base of the finish of the container as shown in FIG. 11. The closure 12 is provided on the interior thereof with tapered lugs 13 adapted to fit between lugs 11 on container 16. The closure 12 also is provided with inwardly extending portions 14 adapted to fit below lugs 11 when the closure 12 is placed on the opening 10 to aid in securely holding the closure 12 on the container opening 10.

The closure is also provided with a ring 14*a* spaced from the inwardly extending portions 14 and is adapted to rest on the tops of lugs 11 so that the interior of the closure 12 is a fixed distance above the lugs 11 and thus compensates for any variations in height of the top of opening 10. The closure also comprises a second ring 15 which fits inside the top of the opening 10.

Figure 2:
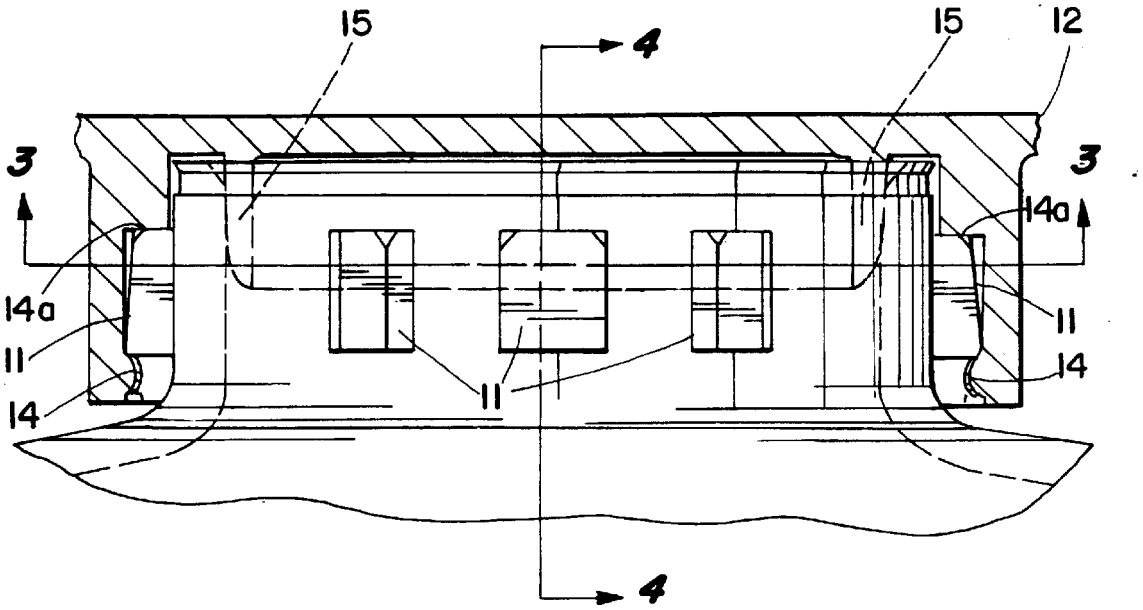
FIG. 2 shows the container top of FIG. 1 with the closure placed on said container top.

Referring now to FIG. 2, the inwardly extending portions 14 and ring 14*a* are shown engaging lugs 11.

Referring now to FIG. 3, which is a section of FIG. 2 with the closure 12 on the opening 10, there is shown the engagement of the lugs 13 with the lugs 11.

Referring now to FIG. 4, which is a section of FIG. 2 on the line 4—4, there is shown the relationship of the lugs 11 to the portions 14 and ring 14*a* as well as the relationship of the ring 15 with the opening 10 of the top of the container.

Figure 5:
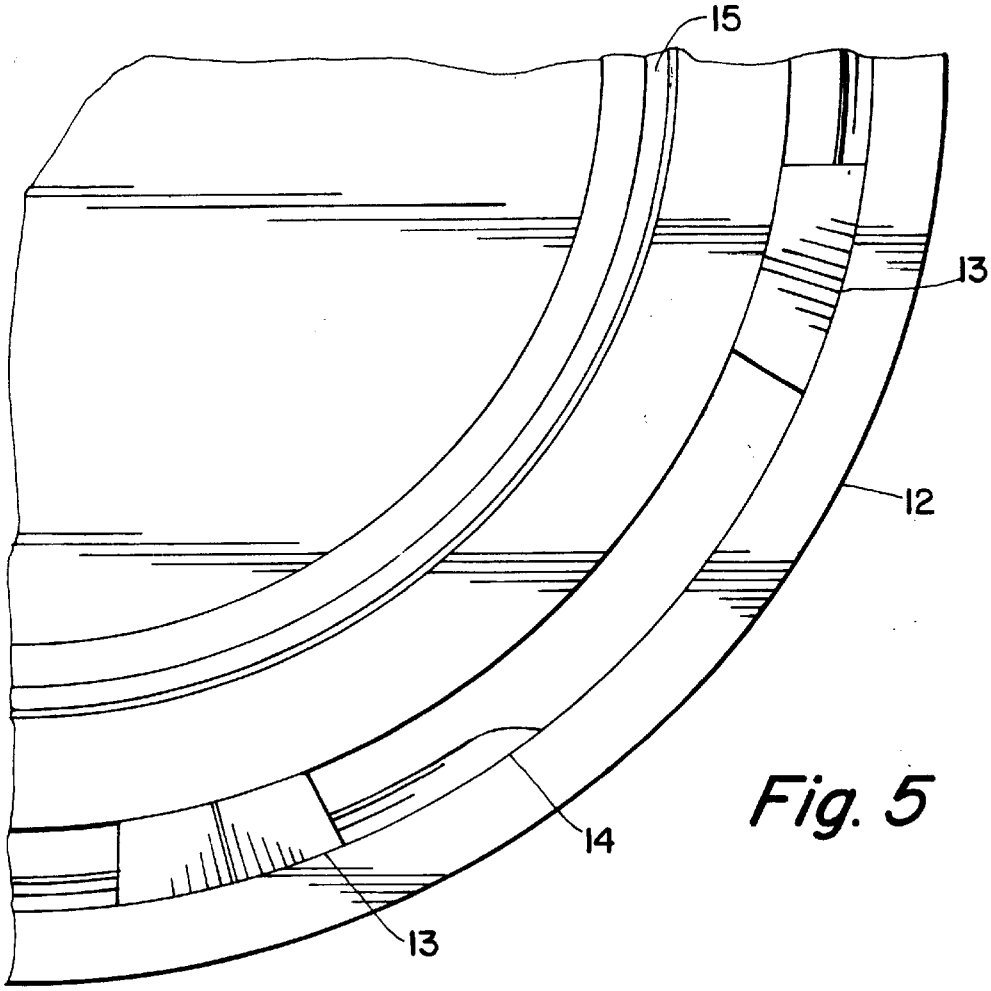
FIG. 5 is an enlarged partial view of the inside of the closure.

Referring now to FIG. 5, there is shown the lugs 13 inside the interior of the closure 12 and the portions 14 as well as the interior ring 15.

Figure 6:
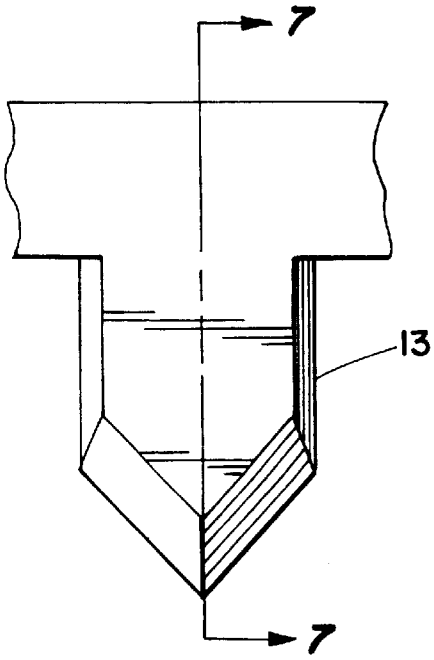
FIG. 6 is an enlarged view of one of the lugs located on the interior of the closure.

Referring now to FIG. 6, there is shown an enlarged view of a lug 13 which is located on the interior of the closure 12 and which is tapered.

Figure 7:
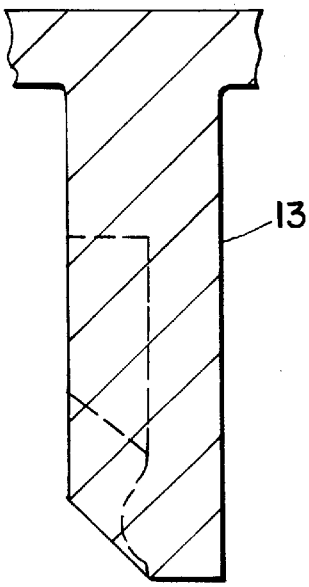
FIG. 7 is a section of the lug shown in FIG. 6 on lines 7—7.

Referring now to FIG. 7, there is shown a section of FIG. 6 on the line 7—7.

Figure 8:
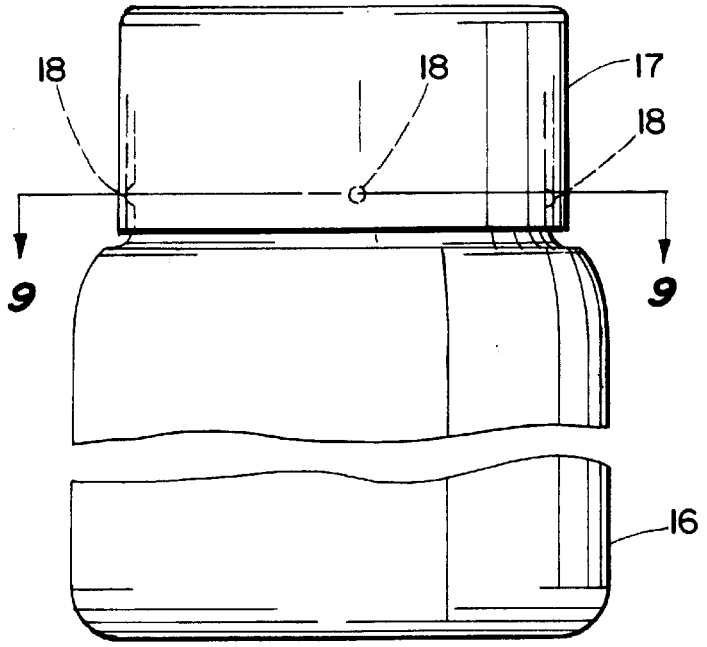
FIG. 8 is a side elevation view of the container with the closure placed thereon.

Referring now to FIG. 8, there is shown the oval container body 16 with the complementary oval closure 17 containing the closure 15 (not shown) positioned on the top of container body 16. There are preferably four protrusions 18 on the exterior of the portion of body 16 near the top thereof. These protrusions around the neck of the container 16 tend to hold the closure 17 in place and help keep the closure 17 from moving once it is placed on the container body 16.

Figure 9:
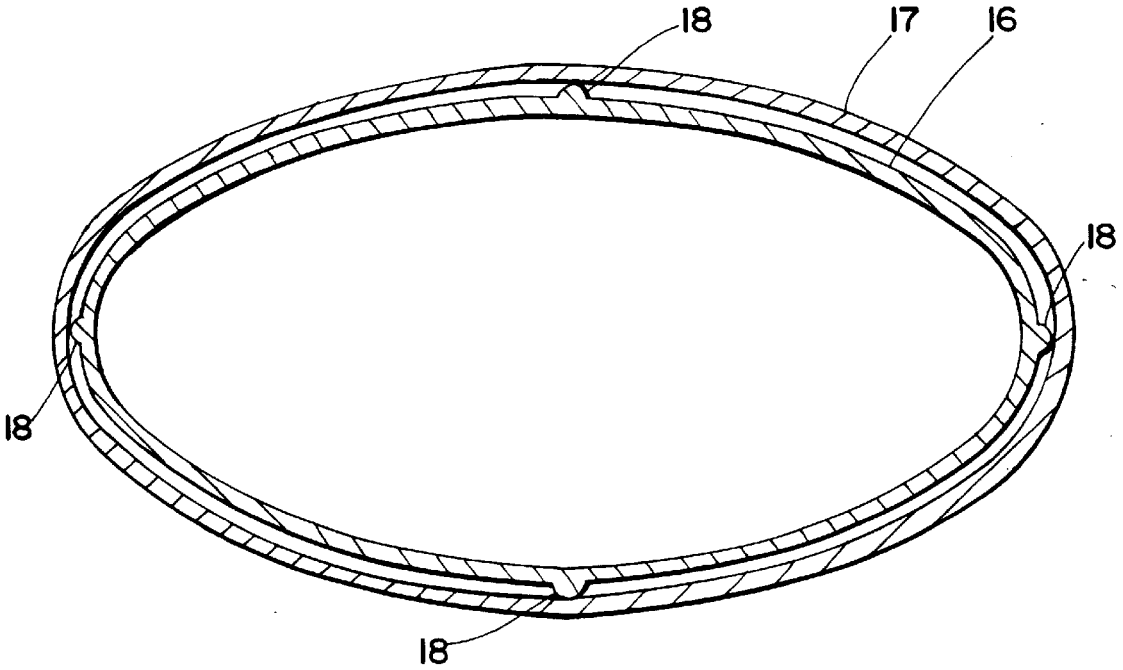
FIG. 9 is a section of FIG. 8 on lines 9—9.

Referring now to FIG. 9, there is shown a section of FIG. 8 on line 9—9.

Figure 10:
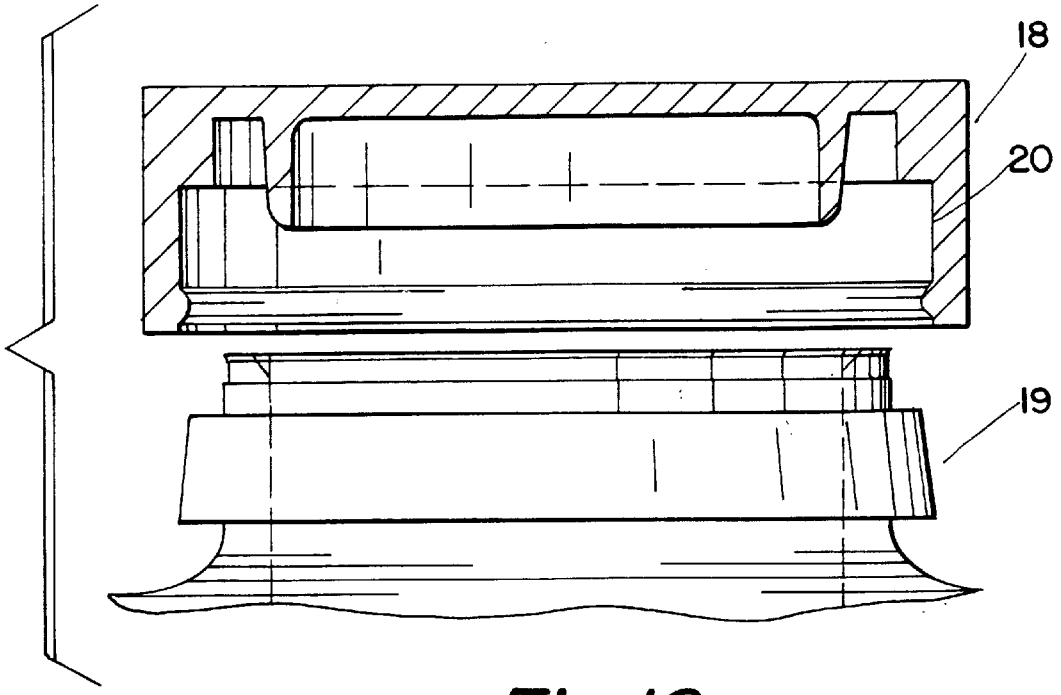
FIG. 10 is a side elevation view showing the opening of the container, showing a ring rather than lugs and spaced from the closure which is partially in section.

Referring now to FIG. 10, there is shown a closure 12*a* similar to the closure shown in FIG. 1 and a container 16 which has a ring 19 surrounding the top thereof in place of the lugs 11. This ring 19 fits within the corresponding portion 20 of the closure 12*a*. This alternative construction is used where the prevention of rotation of the closure of the container is not important.

Referring now to FIG. 11, the closure 21 is shown and the ring 22 is positioned on the base of the finish of the container and engages the portion 27 of the closure similar in manner to that shown in FIG. 10. Again, this can be used where prevention of rotation of the closure is not important. Alternatively, if desired, the lugs 11 and corresponding tapered lugs 13 can be used to replace members 2 and 27 respectively if prevention of rotation is desired.

An additional advantage realized with Applicant's invention is the fact that this structure helps closures become seated on the container on the assembly line as the container moves down the production line.

While this invention has been shown and described with respect to a detailed embodiment thereof, it will be understood by those skilled in the art that various changes in form and detail thereof may be made without departing from the scope of the claims of the invention.

What is claimed is:

1. A combination container and closure comprising:

a container having interior and exterior surfaces and an upper portion terminating in an opening, a plurality of vertically extending lugs projecting from, and horizontally extending around, the exterior surface of the upper portion of said container and equi-spaced from said opening, said closure having a top of a size and shape to cover said opening in said container and having an interior portion extending downwardly over said upper portion of said container, said closure being provided with inwardly projecting, horizontally extending members on the interior portion of said closure and said members being shaped so as to engage said vertically extending lugs on said container both above and below said lugs and being spaced a sufficient distance from the interior of the top of said closure to insure that said interior of said top of said closure is spaced from said container when said closure is on said container, said closure being provided with a plurality of vertically extending lugs, said lugs being provided with parallel vertically extending sides and being so spaced so as to engage said lugs on said container in side by side relationship when said closure is placed on said container.

2. The combination container and closure of claim 1 wherein said closure is provided with a ring extending downwardly from the closure and fits snugly within the opening of said container.

3. The combination container and closure of claim 1 wherein said lugs on the interior of said closure are tapered on the ends which would first engage said lugs on the exterior of said container when said closure is placed on said container.

4. The combination container and closure of claim 1 wherein the container adjacent the opening portion is oval in shape and greater in size than said opening, and wherein said closure is also oval in shape and of a size and shape to compliment the oval portion of said container.

* * * * *